US009737184B2

(12) United States Patent
Kim et al.

(10) Patent No.: US 9,737,184 B2
(45) Date of Patent: Aug. 22, 2017

(54) SUCTION NOZZLE AND VACUUM CLEANER HAVING THE SAME

(71) Applicant: SAMSUNG ELECTRONICS CO., LTD., Suwon-si, Gyeonggi-do (KR)

(72) Inventors: Dong-jun Kim, Suwon-si (KR); Kyoung-woung Kim, Bucheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/837,055

(22) Filed: Aug. 27, 2015

(65) Prior Publication Data

US 2016/0058255 A1 Mar. 3, 2016

(30) Foreign Application Priority Data

Aug. 29, 2014 (KR) ..... 10-2014-0114452

(51) Int. Cl.

| | |
|---|---|
| ***A47L 9/02*** | (2006.01) |
| ***A47L 9/06*** | (2006.01) |
| ***A47L 5/36*** | (2006.01) |

(52) U.S. Cl.

CPC *A47L 9/02* (2013.01); *A47L 5/36* (2013.01); *A47L 9/06* (2013.01); *A47L 9/0606* (2013.01); *A47L 9/0626* (2013.01)

(58) Field of Classification Search

CPC . A47L 9/02; A47L 9/06; A47L 9/0606; A47L 9/0626; A47L 5/36

See application file for complete search history.

(56) References Cited

U.S. PATENT DOCUMENTS

| | | | | |
|---|---|---|---|---|
| 982,640 | A | 1/1911 | Spencer | |
| 1,654,186 | A | 6/1921 | Nulsen | |
| 2,520,942 | A | 9/1950 | Leslie | |
| 6,345,408 | B1 * | 2/2002 | Nagai | A47L 9/02 15/361 |
| 6,664,748 | B2 * | 12/2003 | Kushida | A47L 9/2805 15/319 |
| 2013/0000071 | A1 * | 1/2013 | Itou | A47L 5/14 15/414 |

FOREIGN PATENT DOCUMENTS

| | | |
|---|---|---|
| DE | 30 25 977 | 2/1982 |
| EP | 1 808 113 A2 | 7/2007 |
| EP | 1 964 501 A2 | 9/2008 |

OTHER PUBLICATIONS

Partial European Search Report mailed Feb. 12, 2016 in European Patent Application No. 15181265.8.

European Search Report issue on Aug. 12, 2016 in corresponding European Patent Application No. 15 18 1265.

* cited by examiner

*Primary Examiner* — Dung Van Nguyen

(74) *Attorney, Agent, or Firm* — Staas & Halsey LLP

(57) ABSTRACT

A suction nozzle and a vacuum cleaner are provided. The suction nozzle includes a lower case in which a suction inlet configured to suck dirt on a surface to be cleaned using suction force formed from a suction source and an inclined part including the suction inlet are formed in a bottom of the lower case which faces the surface to be cleaned, and an upper case coupled to an upper side of the lower case, wherein the inclined part is formed to be downwardly inclined towards a left side and a right side of the suction inlet from an arbitrary portion of the inclined part.

18 Claims, 10 Drawing Sheets

SUCTION NOZZLE AND VACUUM CLEANER HAVING THE SAME

CROSS-REFERENCE TO RELATED APPLICATIONS

This application claims priority from Korean Patent Application No. 10-2014-0114452, filed on Aug. 29, 2014, in the Korean Intellectual Property Office, the disclosure of which is incorporated herein by reference in its entirety.

BACKGROUND

1. Field

Apparatuses and methods consistent with exemplary embodiments relate to a vacuum cleaner, and more particularly, to a suction nozzle which separates dirt from a surface to be cleaned and sucks the separated dirt, and a vacuum cleaner having the same.

2. Description of the Related Art

Typically, vacuum cleaners suck the air including dirt from a surface to be cleaned by suction force generated in the vacuum cleaner, separate the dirt from the air, and collect the separated dirt. The vacuum cleaner includes a suction nozzle facing the surface to be cleaned.

In the suction nozzle of the related art, a bottom facing the surface to be cleaned is formed to be flat, and a suction inlet of the suction nozzle is formed to cross the bottom of the suction nozzle along a width direction. When the surface to be cleaned is a wooden floor, such a suction nozzle structure allows the bottom of the suction nozzle to be in uniformly close contact with the wooden floor, and thus a partial loss of suction force may not occur.

However, when the surface to be cleaned is deformed due to the suction force of the suction inlet, such as with a carpet, the surface to be cleaned is not in close contact with the flat bottom of the suction muzzle. That is, the suction force is greatest in a portion of the suction inlet in which a dirt inlet is located, and the suction force is relatively reduced in a portion of the suction inlet disposed gradually away from the dirt inlet, for example, at left and right ends of the suction inlet. Thus, since a portion of the carpet corresponding to the dirt inlet is strongly affected by the suction force, the portion of the carpet is absorbed to the suction inlet, and is in contact with the bottom of the suction nozzle. However, since other portions of the carpet which are not close to the dirt inlet are relatively weakly affected by the suction force, even when the other portions of the carpet are lifted toward the suction inlet, the other portions of the carpet are not completely in contact with the bottom of the suction nozzle and are spaced from the bottom of the suction nozzle. Therefore, a portion between the carpet and the bottom of the suction nozzle, in which loss of the suction force is caused, occurs, and thus cleaning efficiency is degraded.

Further, since the dirt may be tangled with fibers of the carpet, the dirt is not properly sucked up by only the suction force of the suction inlet. In particular, the dirt suction efficiency is remarkably reduced in the portion of the carpet away from the dirt inlet due to the weak suction force.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments are to provide a suction nozzle capable of improving cleaning efficiency while cleaning a surface that is deformed by a suction force of a suction inlet, such as a carpet.

According to an aspect of an exemplary embodiment, there is provided a suction nozzle. The suction nozzle may include: a lower case in which a suction inlet configured to suck dirt on a surface to be cleaned using suction force formed from a suction source and an inclined part including the suction inlet are formed in a bottom of the lower case which faces the surface to be cleaned; and an upper case coupled to an upper side of the lower case wherein the inclined part is formed to be downwardly inclined towards a left side and a right side of the suction inlet from an arbitrary portion of the inclined part.

The inclined part may include a curved surface or a flat surface.

The inclined part may include a pair of sliding surfaces formed to be downwardly inclined towards front and rear outlines of the suction inlet.

The front and rear outlines of the suction inlet may be formed to have the same curvature or slope as the inclined part.

The inclined part may be laterally symmetrically or asymmetrically formed on the basis of a center of the lower case.

The inclined part may be laterally symmetrically or asymmetrically formed on the basis of a portion corresponding to a dirt inlet disposed in an inner side of the suction inlet.

The lower case may further include a sliding protrusion formed to protrude from a portion of the inclined part to reduce friction with the surface to be cleaned in a cleaning operation.

The lower case further includes at least one blowing member disposed in the suction inlet to allow dust existing on the surface to be cleaned to float.

The blowing member may be formed of a material having elastic force.

The blowing member may be a brush.

The lower case may further include an engaging part which the blowing member is engaged thereto and is integrally formed with the lower case.

The surface to be cleaned may be deformed by suction force of the suction inlet, and the inclined part may be in close contact with the surface to be cleaned deformed by the suction force.

According to an aspect of an exemplary embodiment, there is provided a suction nozzle. The suction nozzle may include: a lower case including a suction inlet configured to suck dirt on a surface to be cleaned in a bottom thereof; and an upper case coupled to an upper side of the lower case, wherein the bottom of the lower case has a surface descending towards the surface to be cleaned away from a portion corresponding to a dirt inlet disposed in an inner side of the suction inlet to a width direction of the lower case.

The descending surface may be formed in a curved surface or a flat surface.

Front and rear outlines of the suction inlet may be formed to be descending in the same manner as the descending surface.

The descending surface may be laterally symmetrically or asymmetrically formed on the basis of the portion corresponding to the dirt inlet.

The surface to be cleaned may be deformed by suction force of the suction inlet, and a bottom of the lower case may be in close contact with the surface to be cleaned deformed by the suction force.

According to an aspect of an exemplary embodiment, there is provided a vacuum cleaner. The vacuum cleaner may include: a vacuum cleaner main body including a suction source built therein and configured to collect dust; an extension tube which one end thereof is coupled to the vacuum cleaner main body; and a suction nozzle configured to communicate with the other end of the extension tube and including a suction inlet configured to suck dirt on a surface to be cleaned using suction force formed from the suction source in a bottom thereof, wherein the bottom of the suction nozzle includes a curved surface or a flat surface descending towards the surface to be cleaned away from a portion corresponding to a dirt inlet disposed in an inner side of the suction inlet to a width direction of the suction nozzle.

Front and rear outlines of the suction inlet may be formed to have the same curvature as the descending curved surface or to have the same slope as the descending flat surface.

The surface to be cleaned may be deformed by suction force of the suction inlet, and the bottom of the suction nozzle may be in close contact with the surface to be cleaned deformed by the suction force.

Additional aspects and advantages of the exemplary embodiments will be set forth in the detailed description, will be obvious from the detailed description, or may be learned by practicing the exemplary embodiments.

According to an aspect of another exemplary embodiment, a vacuum cleaner is provided. The vacuum cleaner may include a main body including a suction source, an extension tube having a first end coupled to the main body, and an extension tube having a first end coupled to the main body. A bottom surface of the lower case of the suction nozzle may include a central bottom portion that is substantially parallel to the surface to be cleaned and left and right bottom portions that each descend downwardly toward the surface to be cleaned with respect to the central portion.

According to an aspect of another exemplary embodiment, a suction nozzle of a vacuum cleaner is provided. The suction nozzle may include a lower case having a suction inlet configured to suck debris disposed on a surface to be cleaned using suction force and an inclined part including the suction inlet formed in a bottom surface of the lower case which faces the surface to be cleaned, wherein the inclined part is formed in a symmetrical shape with both lateral ends of the bottom surface of the lower case gradually descending towards the surface to be cleaned with respect to a central portion of the bottom surface of the lower case. The suction nozzle may further include an upper case coupled to an upper side of the lower case.

BRIEF DESCRIPTION OF THE DRAWINGS

The above and/or other aspects will be more apparent by describing in detail exemplary embodiments, with reference to the accompanying drawings, in which.

DETAILED DESCRIPTION

Figure 1:
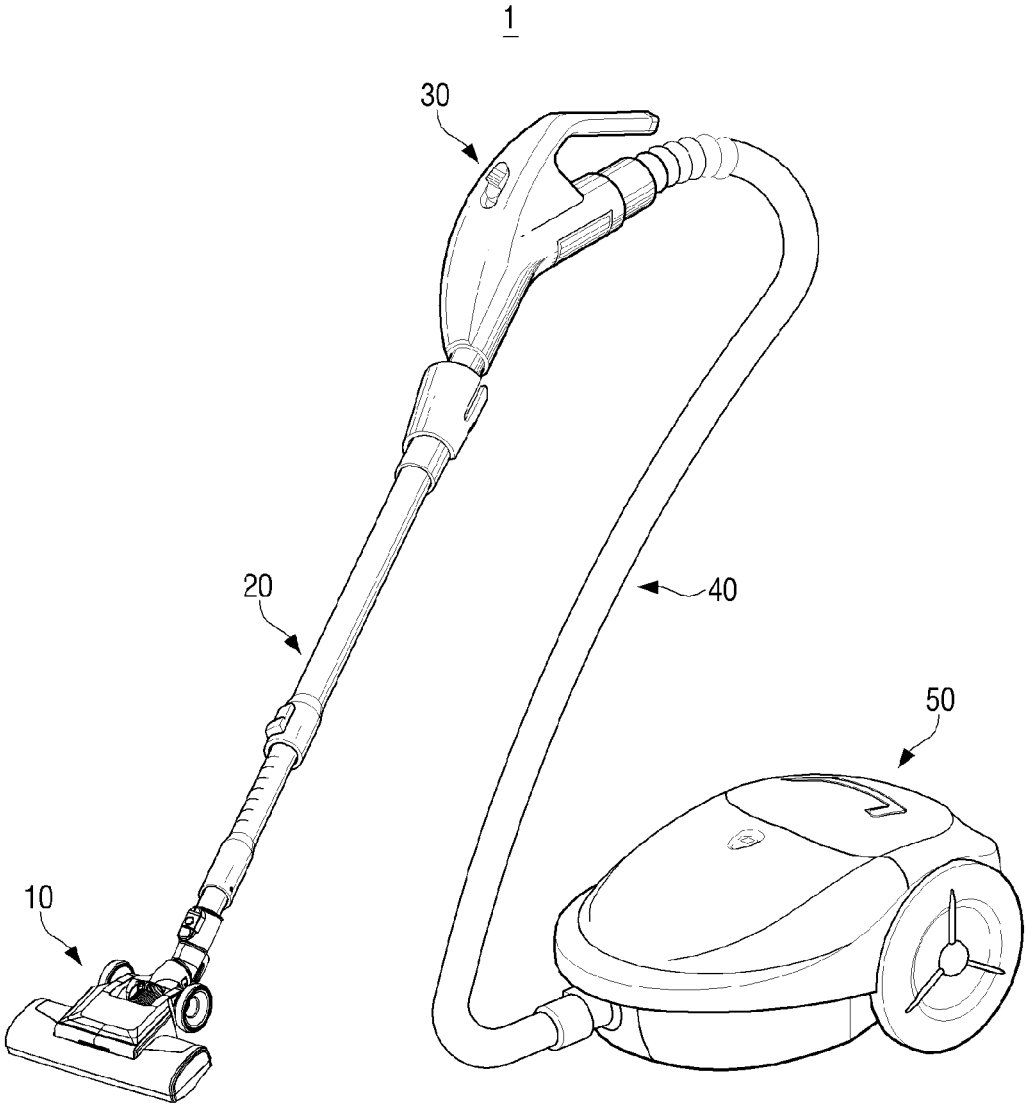
FIG. 1 is a perspective view illustrating a vacuum cleaner including a suction nozzle according to exemplary embodiments.

Hereinafter, exemplary embodiments will be described in more detail with reference to the accompanying drawings.

In the following description, the same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Referring to FIG. 1, a vacuum cleaner 1 according to an exemplary embodiment may include, for example, a suction nozzle 10, an extension tube 20, a handle unit 30, an extension hose 40, and a main body 50. FIG. 1 illustrates a canister type vacuum cleaner, but the suction nozzle 10 according to the exemplary embodiment may be used for an upright type vacuum cleaner and a stick type vacuum cleaner.

The suction nozzle 10 sucks up dirt or debris disposed or located on the surface to be cleaned, and will be described in greater detail hereinafter.

One end of the extension tube 20 is coupled to the suction nozzle 10, and the dirt transferred from the suction nozzle 10 is thereby delivered to the extension hose 40.

The handle unit 30 is provided in the other end of the extension tube 20 so that the user controls the suction nozzle 10, and includes a power switch to operate the vacuum cleaner 1.

The extension hose 40 is coupled to the handle unit 30, and delivers the dirt transferred from the extension tube 20 to the main body 50. The extension hose 40 is formed of a flexible material so that the user can easily perform cleaning.

The main body 50 receives the dirt from the extension hose 40 and includes a suction source, a cyclone unit, and a dust collection chamber.

The above-described extension tube 20, handle unit 30, extension hose 40, and main body 50 and related art thereof are known, and therefore further description thereof will be omitted.

Figure 2:
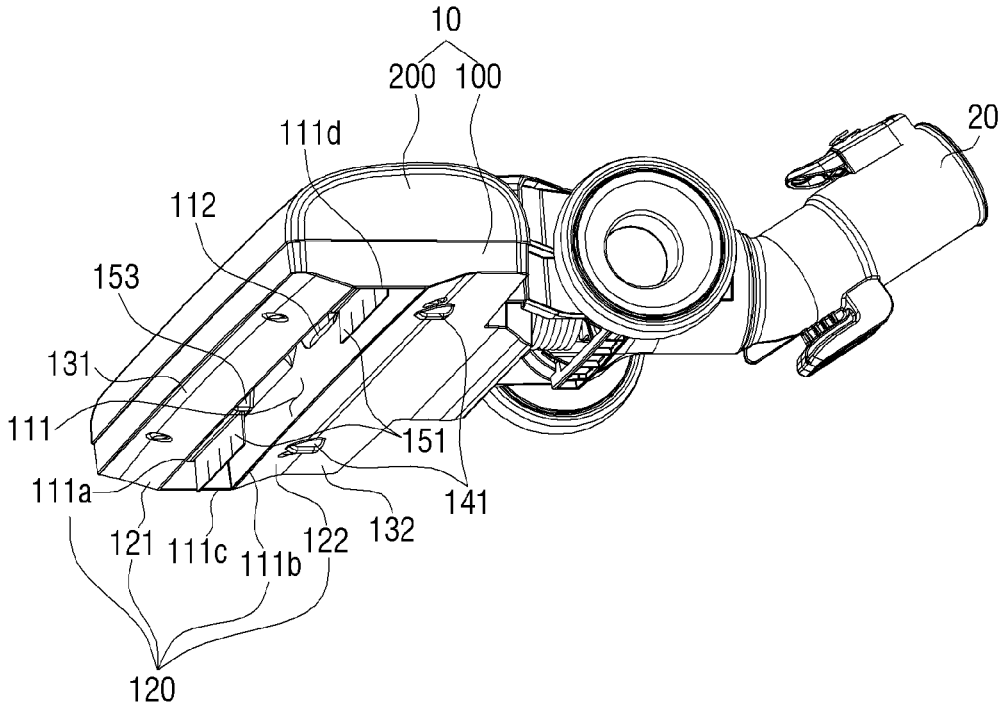
FIG. 2 is a lower-side perspective view illustrating a suction nozzle according to an exemplary embodiment.

Referring to FIG. 2, the suction nozzle 10 according to an exemplary embodiment includes a lower case 100 and an upper case 200.

The lower case 100 constitutes a lower portion of the suction nozzle 10, and may include, for example, a suction inlet 111, a dirt inlet 112, an inclined part 120, a sliding protrusion 141, and a blowing member 151.

The suction inlet 111 is formed in a bottom of the lower case 100 in a width direction (e.g., from a left side to a right side or from the right side to the left side). Further, the suction inlet 111 may be formed to extend to left and right ends of the lower case 100 to clean a wider surface (see 300 of FIG. 3) to be cleaned in a one-time reciprocal operation. The left and right sides of the suction inlet 111 may be closed to prevent suction force from being lost by allowing the suction inlet 111 to be in close with the surface 300 to be cleaned. The suction inlet 111 communicates with the dirt inlet to be described later, and the suction inlet 111 absorbs the dirt of the surface 300 to be cleaned by receiving the suction force from the dirt inlet 112 and transfers the dirt to the dirt inlet 112.

The suction inlet 111 is formed to protrude with respect to bottom surfaces 131 and 132 of the lower case 110 in a direction of the surface 300 to be cleaned. In an embodiment, bottom surfaces 131 and 132 of the lower case 100 face or oppose the surface 300 to be cleaned. Thus, the suction inlet 111 may be in closer contact with the surface 300 to be cleaned and a space in which the suction force is to be lost may be minimized. Therefore, the loss of the suction force in the suction inlet 111 may be reduced, and the cleaning efficiency is further improved. However, the structure of the suction inlet 111 is not limited thereto, and although not shown in the drawings, the suction inlet 111 may be formed to have the same height as the bottom surfaces 131 and 132 of the lower case 100.

The dirt inlet 112 is formed in the suction inlet 111 and communicates with the extension tube 20 to transfer the air including the dirt flowing in through the suction inlet 111 to the extension tube 20 coupled to the rear of the lower case 100. The dirt inlet 112 allows the suction force to be generated in the whole suction inlet 111 by receiving the suction force from the suction source built into the main body 50 of the vacuum cleaner 1.

The dirt inlet 112 may be formed in a central portion of the lower case 100 and may allow the suction force to be uniformly generated in both the left and right portions of the dirt inlet 112. The dirt inlet 112 is coupled to the extension tube 20, and the handle unit 30 is provided in the extension tube 20 in order for the user to manipulate the suction nozzle 10. The dirt inlet 112 may be preferably formed in a central portion of the suction nozzle 10 in terms of manipulation of the suction nozzle 10.

The inclined part 120 includes front and rear sliding surfaces 121 and 122 formed in the bottom of the lower case 100.

The inclined part 120 is formed along a width direction of the lower case 100, and a central portion of the inclined part 120 is formed to be recessed in a direction of the upper case 200 from the surface 300 to be cleaned. That is, the inclined part 120 has an inclined shape so that bottom surfaces of the left and right sides of the lower case 100 are located closer to the surface 300 to be cleaned than a bottom surface of the central portion thereof, and the inclined part 120 has a certain or predetermined curvature. For example, in an embodiment of the inclined part 120, the bottom surface of each of the left and right sides of the lower case 100 gradually descends closer towards the floor surface as the bottom surface extends from a central portion to an extreme end portion closest to a left or ride side of the suction inlet respectively. The gradual descent towards the floor surface of the bottom surface may be a linear descent or curved descent. The shape of the inclined part 120 is configured to correspond approximately to a shape of the surface 300 to be cleaned when it is deformed by the suction force. The surface 300 to be cleaned may be a carpet, for example, but the surface 300 to be cleaned is not limited to carpet and may include any surface to be cleaned which may be deformed by the suction force. Further, the surface 300 to be cleaned may alternatively be a surface that is not deformed by the suction. However, for clarity, the exemplary embodiment will be described by focusing on the carpet 300 as the surface to be cleaned hereinafter.

Figure 3:
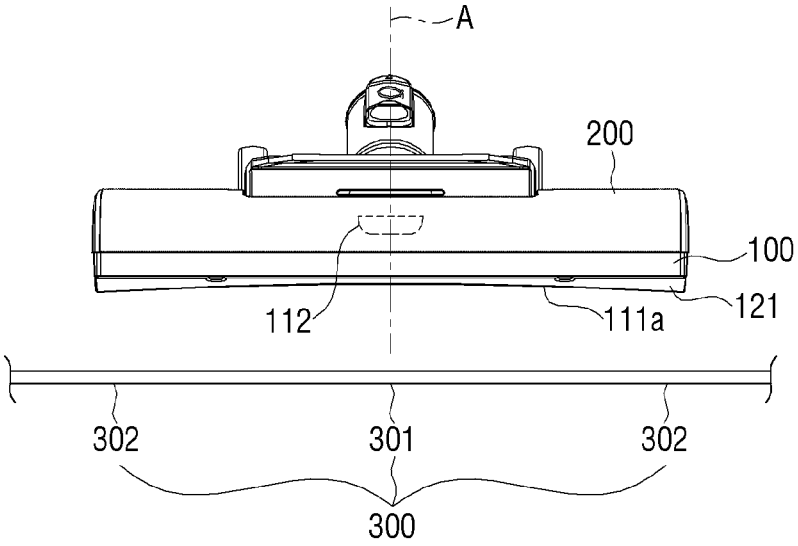
FIG. 3 is a front view illustrating the suction nozzle illustrated in FIG. 2 before the suction nozzle performs a suction operation and a surface to be cleaned.
Figure 4:
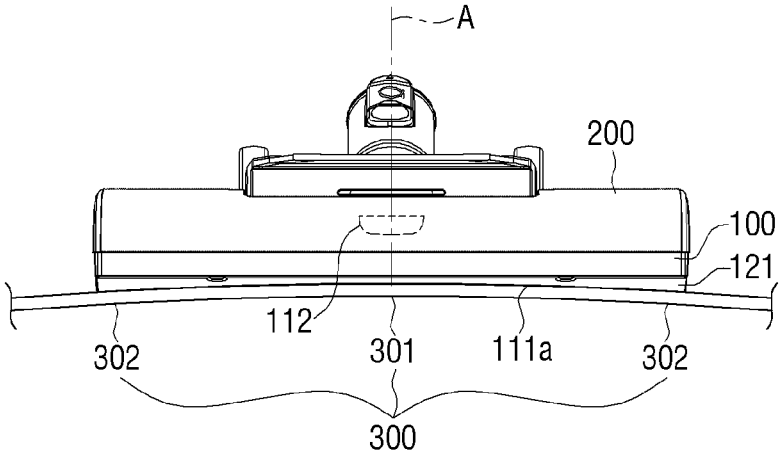
FIG. 4 is a front view illustrating the suction nozzle illustrated in FIG. 2 while the suction nozzle performs a suction operation and a surface to be cleaned.

The shape of the inclined part 120 will be described in detail with reference to FIGS. 3 and 4. FIGS. 3 and 4, as an example only, are exaggeratedly expressed for clarity as compared with the substantially inclined part and the deformation degree of the carpet 300.

The carpet 300 is lifted up in a direction of the upper case 200 by the suction force of the suction inlet 111 as illustrated in FIG. 4. However, since the suction force is not uniformly formed over the whole of the suction inlet 111, a central portion 301 of the carpet 300 is lifted up in a convex shape towards the dirt inlet 112 corresponding to the largest suction force. According to the shape of the carpet 300, the inclined part 120 is formed to be inclined so that a portion of the inclined part in which the dirt inlet 112 having the largest suction force is formed has the most convex shape.

The suction force is reduced in a portion of the suction inlet 111 formed in the left and right sides of the dirt inlet 112 away from the dirt inlet 112 (for example, towards the extreme left and right surfaces of the suction inlet 111). Therefore, the left and right surfaces 302 of the carpet 300 corresponding thereto are lifted up less than in the central portion 301, and left and right surfaces 302 of the carpet 300 are dropped downwards as compared with the central portion 301. The inclined part 120 is thus configured to have a shape that drops downward in the left and right sides as compared with the central portion in which the dirt inlet 112 is formed. That is, in an embodiment, the inclined part 120 is configured to have a shape that gradually slopes downward at the left and right sides toward the surface to be cleaned, as compared with the central portion.

Since the reduction level of the suction force may be uniform towards the left and right sides away from the dirt inlet 111, the carpet 300 is also obliquely formed to be laterally symmetrical on the basis of the central portion 301 lifted up.

Figure 5:
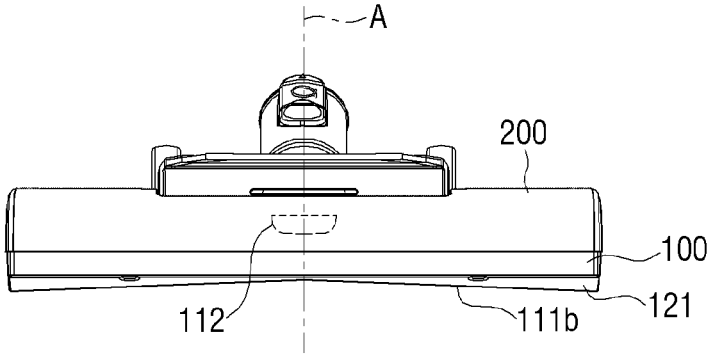
FIGS. 5 to 7 are front views illustrating suction nozzles according to other exemplary embodiments.

Referring to FIG. 5, the bottom of the lower case 100 may be formed as a flat surface 111*b* in which both ends thereof are downwardly descending with a certain or predetermined slope on with respect to the dirt inlet 111. As another example, the bottom of the center portion of the lower case may be formed as a flat surface substantially parallel to the floor to be cleaned and both end portions of the lower case slope downwardly toward the floor as the end portions extend away from the center portion of the lower case.

Figure 6:
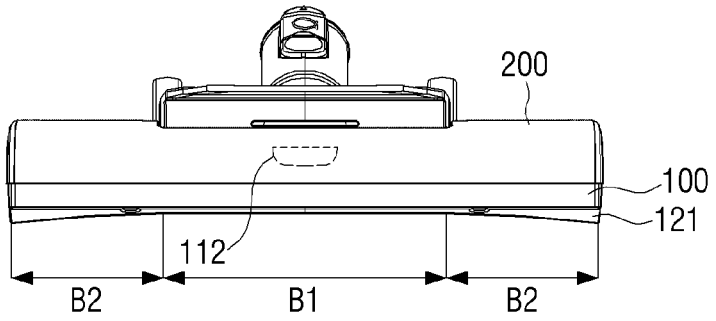

Referring to FIG. 6, the bottom of the lower case 100 may be formed so that a central portion B1 in which the dirt inlet 111 is formed is parallel to the bottom surfaces 131 and 132 of the lower case 100, and only left and right portions B2 other than the central portion B1 are curved. Although not shown in FIG. 6, the left and right portions B2 may be formed as a flat surface of which both ends are downwardly descending as illustrated in FIG. 5, i.e., descending toward a surface to be cleaned. In an alternative embodiment the left and right portions may be referred to as left and right extremities of the lower case.

That is, the bottom of the lower case may have any shape corresponding to the shape of the carpet 300 in which the central portion 301 is lifted up by the suction force and the left and right portions (302) or extremities descend downwardly compared with the central portion 301.

The inclined part 120 may be laterally symmetrically formed on the dirt inlet 112 having the largest suction force based on the shape of the carpet 300. For example, the inclined part 120 may be formed so that the left and right portions 302 are symmetrical with respect to the dirt inlet 112. Further, as described above, since the dirt inlet 112 may be formed in the central portion of the suction nozzle 10, the inclined part 120 may be laterally symmetrically formed with respect to a reference line A which is the center of the suction nozzle 10.

Figure 7:
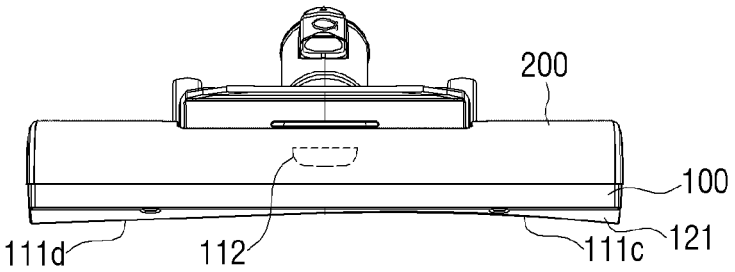
Figure 8:
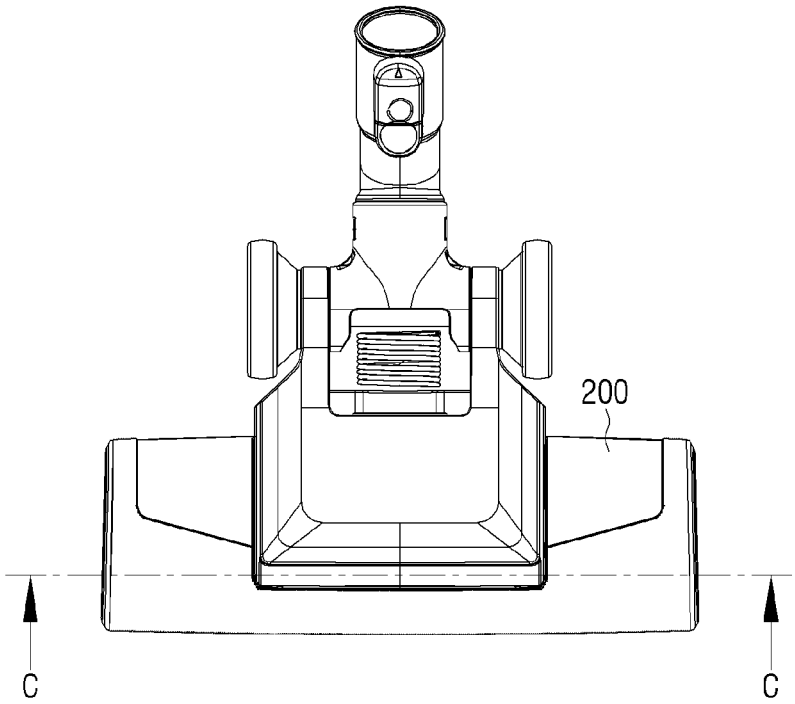
FIG. 8 is a top view illustrating the suction nozzle illustrated in FIG. 2.

However, the inclined part 120 is not limited thereto, and inclined part 120 may have an asymmetrical shape as illustrated in FIG. 7. That is, as illustrated in FIG. 7, the inclined part 120 may be formed so that a right bottom 111*c* and a left bottom 111*d* may be formed to have different curvatures from each other.

Although not shown in FIG. 7, the right bottom 111*c* is curvedly formed and the left bottom 111*d* is formed in a flat surface. Alternatively, the left bottom 111*d* is curvedly formed and the right bottom 111*c* is formed in a flat surface. However, since some cleaning operations are not easily performed when the suction nozzle 10 is tilted in one direction in the cleaning operation, the left and right ends of the lower case 100 may have the same height.

As described above, the inclined part 120 is formed to correspond to the shape of the carpet 300 when deformed by the suction force, and thus the suction nozzle 10 is in uniformly close contact with the deformed carpet 300. Therefore, the loss of the suction force is minimized, and the cleaning efficiency is increased.

Further, as described above, the suction inlet 111 is formed to protrude downward to the direction of the carpet 300 to be closer to the carpet 300 than the bottom surfaces 131 and 132 of the lower case 100. Therefore, the front and rear outlines 111*a* and 111*b* of the suction inlet 111, which the carpet is in close contact with, also are formed to be inclined with a certain curvature like the inclined part 120, so that the suction nozzle may be in uniformly contact with the carpet 300.

Specifically, the front and rear outlines 111*a* and 111*b* of the suction inlet 111 may be obliquely formed in a direction of the upper case 200 in accordance with the left and right outlines 111*c* and 111*d*. That is, the left and right outlines 111*c* and 111*d* may be dropped downwards more than the central portion of the suction inlet 111 in which the dirt inlet 112 is formed. Such a shape corresponds to the shape of the carpet 300 lifted up by the suction force. Since the carpet 300 is lifted up to the same height with respect to the front and rear of the suction inlet 111, the front and rear outlines 111*a* and 111*b* are obliquely formed to have the same curvature.

The front and rear outlines 111*a* and 111*b* of the suction inlet 111 may be obliquely formed to have the same curvature as the inclined part 120. Therefore, the carpet 300 may be in uniformly close contact with the inclined part 120 of the suction nozzle 10, and the cleaning efficiency may be increased by minimizing the loss of the suction force.

The front and rear sliding surfaces 121 and 122 are formed to be downwardly inclined towards the front and rear outlines 111*a* and 111*b* of the suction inlet 111 from the bottom surfaces 131 and 132 of the lower case 100. When the suction inlet 111 is formed so as to protrude towards the carpet 300, the front and rear sliding surfaces 121 and 122 are provided to prevent the suction nozzle 10 from being caught in the carpet 300 when the suction nozzle 10 performs the cleaning operation by traveling between the front and rear, and to be easily manipulated by the user.

That is, when the suction nozzle 10 performs the cleaning operation by traveling between the front and rear, the front and rear sliding surfaces 121 and 122 allow the suction nozzle 10 to smoothly move on a surface of the carpet 300.

The lower case 100 may include at least one sliding protrusion 141 formed to protrude from a portion of the inclined part 120 in order for the user to easily manipulate the suction nozzle 10. As illustrated in FIG. 2, the sliding protrusion 141 is provided in the left and right sides of the suction nozzle 10 on the basis of the central portion of the suction nozzle 10, but the sliding protrusion is not limited thereto.

The at least one sliding protrusion 141 reduces friction force with the carpet 300 by reducing a contact area between the suction nozzle 10 and the carpet 300. Thus, the user may smoothly manipulate the suction nozzle 10 forward and backward.

Figure 9:
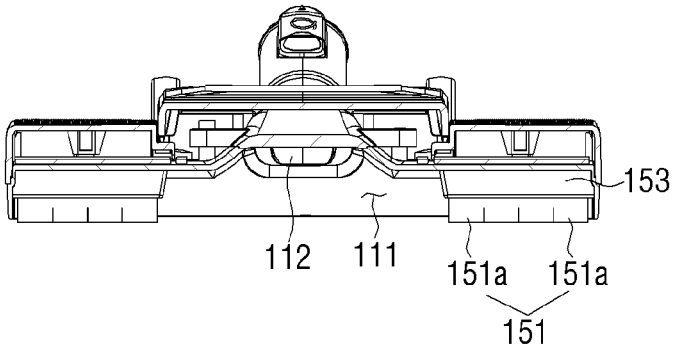
FIG. 9 is a cross-sectional view illustrating the suction nozzle taken along line C-C of FIG. 8.
Figure 10:
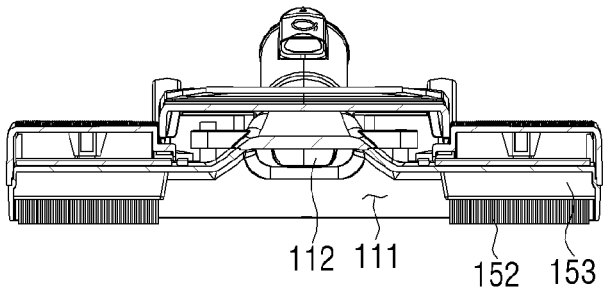
FIG. 10 is a cross-sectional view illustrating a suction nozzle taken along line C-C of FIG. 8 according to another exemplary embodiment.

Referring to FIGS. 9 and 10, a blowing member 151 according to an exemplary embodiment is disposed in an inner side of the suction inlet 111, and one blowing member 151 is provided in either side of the dirt inlet 112. However, the blowing member is not limited thereto, and although not shown in FIGS. 9 and 10, at least two or more blowing members may be provided in either side of the dirt inlet 112 at a certain interval. One blowing member 151 or more having a shape that includes a central portion in which the dirt inlet 112 is formed and crosses the dirt inlet 112 may be provided. The blowing member 151 may be provided in the sliding surfaces 121 and 122 which are an outside of the suction inlet 111 or the bottom surfaces 131 and 132 of the lower case.

The blowing member 151 may be formed of an elastic member, preferably, rubber, but the material for the blowing member is not limited thereto. The blowing member 151 increases the suction efficiency to the inside of the suction inlet 111 by allowing dust existing in the carpet 300 to float.

The lower portion of the blowing member 151 may be divided into two or more blowing portions 151*a* to have an independent motion to the irregular carpet 300. Thus, the friction force of the blowing member 151 with the carpet 300 is further reduced. However, although not shown in FIGS. 9 and 10, the blowing member 151 which is not divided into the two or more blowing portions 151*a* may be used.

An engaging part including a slot, which the blowing member 151 may be coupled to, is integrally formed with the lower case 100. The number of engaging parts 153 may be equal to the number of the blowing member 151 to be inserted thereinto. Therefore, the engaging part may be formed in both sides of the inner side of the suction inlet 111, and may be formed to cross the central portion of the suction nozzle in which the dirt inlet 112 is formed. The engaging part 153 may be provided in the sliding surfaces 121 and 122 which are the outer side of the suction inlet 111 or the bottom surfaces 131 and 132 of the lower case 100. An injection molding may be used for the method of integrally forming the engaging part with the lower case 100, but the method of integrally forming the engaging part with the lower case 100 is not limited thereto.

As described above, as the engaging part is integrally formed with the lower case 100, the engaging part may facilitate the maintenance and repair by the user. Specifically, when the blowing member 151 is damaged or worn so that the blowing member 151 cannot strike the carpet 300, it is necessary to replace the blowing member 151. At this time, the user may simply separate the blowing member 151 engaged in the engaging part 153 from the lower case 100 by separating the upper case 200 from the lower case 100. Then, the user may use the vacuum cleaner by replacing the separated blowing member 151 with a new blowing member 151, and thus the cleaning efficiency may be further improved.

The manufacturer may also facilitate the fabrication and assembly of parts in the suction nozzle 10, and the productivity may be improved.

Further, referring to FIG. 10, the blowing member may be configured of a plurality of brushes 152. The plurality of brushes 152 may have elastic force. The plurality of brushes 152 may also be mounted on the engaging part 153 integrally formed with the lower case 100. Therefore, the engaging part 153 is provided to correspond to the number and sizes of brushes 152. As illustrated in FIG. 10, one brush may be provided in either side of the dirt inlet 112. However, the brush 152 is not limited thereto, and at least two brush or more may be provided in either side of the dirt inlet 112 at a certain interval.

The upper case 200 is coupled to an upper side of the lower case 100 so that the inside of the suction nozzle 10 is not exposed to the outside. The upper side of the lower case 100 is sealed to prevent the loss of the suction force.

Hereinafter, a suction process of the suction nozzle 10 having the above-described configuration according to an exemplary embodiment will be described.

Referring to FIG. 3, the suction nozzle 10 is in a stand-by state, and thus the carpet 300 is not lifted up towards the suction nozzle 10.

Referring to FIG. 4, the suction nozzle 10 starts a suction operation for cleaning.

As described above, the suction force is generated from the suction source of the main body 50, and transferred to the dirt inlet 112 through the extension hose 40 and the extension tube 20. The suction force transferred to the dirt inlet 112 is transferred to the suction inlet 111 formed in both sides of the dirt inlet 112, and the suction inlet 111 sucks the dirt of the carpet 300 using the suction force.

The suction force of the suction inlet 111 is largest in the dirt inlet 112, and is reduced towards the left and right sides of the dirt inlet 112 away from the dirt inlet 112. According to the difference of the suction force, the carpet 300 is largest lifted up in the central portion 301, and the left and right surfaces 302 are less lifted up than in the central portion 301, and dropped downwards.

In the exemplary embodiment, the inclined part 120 corresponding to the shape of the carpet 300 is provided, and the carpet 300 is in uniformly close contact with an inclined shape of the inclined part 120. Specifically, the carpet 300 is in close contact with the outlines 111*a* to 111*d* of the suction inlet 111. When the suction nozzle 10 moves forwards and backwards for cleaning, the carpet 300 is in close contact with portions of the front and rear sliding surfaces 121 and 122 and thus a space which causes the loss of the suction force is minimized.

The blowing members 151 and 152 protrude towards the carpet 300 to strike the surface of the carpet 300 in the suction inlet 111. Since the blowing members 151 and 152 are formed of an elastic material such as rubber, the blowing members 151 and 152 may not affect the front and rear operation of the suction nozzle 10, and may strike the surface of the carpet 300.

Specifically, when the blowing members 151 and 152 physically strike the dirt entangled in the surface of the carpet 300, the stricken dirt is separated from the surface of the carpet 300, and the separated dirt is sucked to the suction inlet 111 by the suction force and transferred to the dirt inlet 112.

Further, since the blowing members 151 and 152 are disposed in the inside of the suction inlet 111, the blowing members 151 and 152 strike the carpet to separate the dirt from the surface of the carpet 300 and simultaneously to suck the dirt through the suction inlet 111. Therefore, the dirt may be efficiently separated from the carpet 300, and thus the cleaning efficiency is improved.

The foregoing exemplary embodiments and advantages are merely exemplary and are not to be construed as limiting the present inventive concept. The exemplary embodiments can be readily applied to other types of devices. Also, the description of the exemplary embodiments is intended to be illustrative, and not to limit the scope of the claims, and many alternatives, modifications, and variations will be apparent to those skilled in the art.

What is claimed is:

1. A suction nozzle comprising:

a lower case, in a portion of the lower case that faces a surface to be cleaned, including:

a suction inlet configured to suck dirt disposed on the surface to be cleaned using suction force, an inclined part including:

a front surface formed to be downwardly curved towards a left side and a right side of the suction inlet from an arbitrary portion of the front surface such that a central portion is formed to be recessed in a direction of an upper case from the surface to be cleaned, and downwardly curved towards a front outline of the suction inlet, and a rear surface formed to be downwardly curved towards the left side and the right side of the suction inlet from an arbitrary portion of the rear surface such that a central portion is formed to be recessed in a direction of the upper case from the surface to be cleaned, and downwardly curved towards a rear outline of the suction inlet; and the upper case coupled to an upper side of the lower case.

2. The suction nozzle as claimed in claim 1, wherein the at least one of the surface formed to be downwardly inclined towards the front outline of the suction inlet and the surface formed to be downwardly inclined towards a rear outline of the suction inlet includes a pair of sliding surfaces formed to be downwardly inclined towards the front and the rear outlines of the suction inlet.

3. The suction nozzle as claimed in claim 2, wherein the front and rear outlines of the suction inlet are formed to have a similar curvature or slope as the inclined part.

4. The suction nozzle as claimed in claim 1, wherein the inclined part is laterally symmetrically formed with respect to a center of the lower case.

5. The suction nozzle as claimed in claim 1, wherein the inclined part is laterally symmetrically formed with respect to a portion corresponding to a dirt inlet disposed in an inner side of the suction inlet.

6. The suction nozzle as claimed in claim 1, wherein the lower case further includes a sliding protrusion formed to protrude from a portion of the inclined part to reduce friction with the surface to be cleaned in a cleaning operation.

7. The suction nozzle as claimed in claim 1, wherein the surface to be cleaned is deformed by suction force of the suction inlet, and the inclined part is configured to be in close contact with the surface to be cleaned deformed by the suction force.

8. A suction nozzle comprising:

a lower case, in a portion of the lower case that faces a surface to be cleaned, including:

a suction inlet configured to suck dirt disposed on a surface to be cleaned using suction force, an inclined part including:

a front surface formed to be downwardly curved towards a left side and a right side of the suction inlet from an arbitrary portion of the front surface such that a central portion is formed to be recessed in a direction of an upper case from the surface to be cleaned, and downwardly curved towards a front outline of the suction inlet, and a rear surface formed to be downwardly curved towards the left side and the right side of the suction inlet from an arbitrary portion of the rear surface such that a central portion is formed to be recessed in a direction of the upper case from the surface to be cleaned, and downwardly curved towards a rear outline of the suction inlet; and at least one blowing member disposed in the suction inlet to allow dust existing on the surface to be cleaned to float; and the upper case coupled to an upper side of the lower case.

9. The suction nozzle as claimed in claim 8, wherein the blowing member is formed of a material having elastic force.

10. The suction nozzle as claimed in claim 8, wherein the blowing member is a brush.

11. The suction nozzle as claimed in claim 8, wherein the lower case further includes an engaging part coupled to the blowing member and integrally formed with the lower case.

12. A suction nozzle comprising:

a lower case including:

a suction inlet configured to suck dirt disposed on a surface to be cleaned, the suction inlet being disposed in a bottom of the lower case, and at least one of a surface formed to be downwardly curved towards a front outline of the suction inlet and a surface formed to be downwardly curved towards a rear outline of the suction inlet; and an upper case coupled to an upper side of the lower case, wherein at least one of the surface formed to be downwardly curved towards a left side and a right side of the suction inlet from an arbitrary portion of the surface and formed to descend towards the surface to be cleaned in a width direction away from a portion corresponding to a dirt inlet disposed in an inner side of the suction inlet.

13. The suction nozzle as claimed in claim 12, wherein the front and the rear outlines of the suction inlet are formed to have a similar curvature.

14. The suction nozzle as claimed in claim 12, wherein the at least one of the surface formed to be downwardly curved towards the left side and the right side of the suction inlet from an arbitrary portion of the surface is laterally symmetrically formed with respect to the portion corresponding to the dirt inlet.

15. The suction nozzle as claimed in claim 12, wherein the surface to be cleaned is deformed by suction force of the suction inlet, and a bottom of the lower case is configured to be in close contact with the surface to be cleaned deformed by the suction force.

16. A vacuum cleaner comprising:

a vacuum cleaner main body including a suction source built therein and configured to collect debris;

an extension tube having one end coupled to the vacuum cleaner main body; and a suction nozzle configured to communicate with another end of the extension tube and including a suction inlet disposed in a bottom of the suction nozzle and configured to suck debris on a surface to be cleaned using suction force formed from the suction source and at least one of a surface formed to be downwardly curved towards a front outline of the suction inlet and a surface formed to be downwardly curved towards a rear outline of the suction inlet, wherein at least one of the surface formed to be downwardly curved towards a left side and a right side of the suction inlet from an arbitrary portion of the surface, and formed to descend towards the surface to be cleaned as the bottom extends away from a portion corresponding to a dirt inlet disposed in an inner side of the suction inlet in a width direction of the suction nozzle.

17. The vacuum cleaner as claimed in claim 16, wherein the front and the rear outlines of the suction inlet are formed to have a similar curvature as the descending curved surface or to have the same slope as the descending flat surface.

18. The vacuum cleaner as claimed in claim 16, wherein the surface to be cleaned is deformed by suction force of the suction inlet, and the bottom of the suction nozzle is configured to be in close contact with the surface to be cleaned deformed by the suction force.

* * * * *